US005560230A

United States Patent [19]

Wang et al.

[11] Patent Number: 5,560,230

[45] Date of Patent: Oct. 1, 1996

[54] CHAOS WASHING MACHINE AND A METHOD OF WASHING THEREOF

[75] Inventors: Bo H. Wang; Seok B. Koh; Seung K. Ahn; Shounak Roychowdhury, all of Seoul, Rep. of Korea

[73] Assignee: Goldstar Co., Ltd., Seoul, Rep. of Korea

[21] Appl. No.: 305,102

[22] Filed: Sep. 13, 1994

[30] Foreign Application Priority Data

Sep. 13, 1993 [KR] Rep. of Korea ..... 1993-18343
Sep. 28, 1993 [KR] Rep. of Korea ..... 1993-20062

[51] Int. Cl.[6] ..... D06F 17/02

[52] U.S. Cl. ..... 68/184; 134/193; 366/300

[58] Field of Search ..... 68/184; 134/193; 366/293, 296, 297, 300

[56] References Cited

U.S. PATENT DOCUMENTS

| | | | |
|---|---|---|---|
| 1,409,271 | 3/1922 | Bartelt | 68/184 |
| 1,566,312 | 12/1925 | Coates | 68/184 |
| 2,119,254 | 5/1938 | Whiteley | 68/184 |
| 2,680,367 | 6/1954 | Dougherty | 68/184 |
| 3,033,712 | 5/1962 | Brevik | 68/184 X |
| 3,467,975 | 9/1969 | Fleissner | 68/184 X |

FOREIGN PATENT DOCUMENTS

| | | | |
|---|---|---|---|
| 46869 | 3/1911 | Germany | 68/184 |
| 472670 | 6/1952 | Italy | 68/184 |

*Primary Examiner*—Philip R. Coe
*Attorney, Agent, or Firm*—Spencer & Frank

[57] ABSTRACT

This invention relates to a chaos washing machine for improving washing power and preventing the twist of clothes comprising a first washing tank having a plurality of induce holes for inducing the water current in which a detergent dissolved into the space where the laundry is contained, a second washing tank for enclosing the washing tank to be filled with water and a detergent, water current fans and fan motors occurring a turbulent flow to water in which a detergent is dissolved and pushing the turbulent flow from the second washing tank through the induce holes into the first washing tank and a washing tank motor for rotating the first washing tank.

9 Claims, 6 Drawing Sheets

CHAOS WASHING MACHINE AND A METHOD OF WASHING THEREOF

FIELD OF THE INVENTION

The present invention relates to washing machines and, more particularly, to a chaos washing machine with improved washing power and prevents wrinkling of clothes by altering the direction of water current.

DESCRIPTION OF THE PRIOR ARTS

Washing machines presently employed use a pulsator or drum. The washing machines using the pulsator increase the washing power by irregular flow of washing water in the washing tank by repeatedly rotating the pulsator disposed in the bottom of the washing tank clockwise and counter-clockwise.

The washing machine using the drum increases the washing power by a head of laundry derived by rotating the drum itself in which the laundry and washing water are contained.

However, such washing machines using the pulsators have the disadvantage in that the laundry is wrinkled while being rotated together with the washing water, and further, it is difficult to obtain the higher washing effect due to limitations of the washing power that is dependent on the rotation power of water current.

On the other hand, washing machines using the drum have the disadvantage due to the difficulty of obtaining the higher washing effect because of the limited washing power that is dependent on the head of the laundry, as well as the laundry being wrinkled by the regular and reverse rotation of the drum.

Further, a problem exists in that the manufacturing cost increases because an additional program or hardware, must be installed in order to prevent the wrinkling of the laundry.

SUMMARY OF THE INVENTION

It is an object of the present invention to provide a chaos washing machine which can improve the washing effect by using the random generation of water current in order to overcome the aforementioned defects.

It is another object of the present invention to provide a chaos washing machine which can reduce the wrinkling of the laundry by creating a random stream of water for short periods, random generation of the water stream and then producing a strong turbulent flow in the washing tank.

It is a further object of the present invention to provide a method of washing of a chaos washing machine which can improve a washing power and prevent the wrinkling of clothes by using the random generation of the water current.

These and other objects of the present invention are accomplished by means of a chaos washing machine which is composed of a first washing tank having a plurality of inducing holes for inducing the water current in which a detergent dissolved into the space where the laundry is contained, a second washing tank for enclosing the washing tank to be filled with water and a detergent, a water current fan and a fan motor creating a turbulent flow to water in which a detergent is dissolved and pushing the turbulent flow from the second washing tank through the inducing holes into the first washing tank and a washing tank motor for rotating the first washing tank.

BRIEF DESCRIPTION OF THE DRAWINGS

The above objects and other advantages of the present invention will become more apparent by describing preferred embodiments of the invention with reference to the attached drawings, in which.

DETAILED DESCRIPTION OF THE INVENTION

FIGS. 1 to 4 explain the principle of a chaos water current in the dynamics system employed to the chaos washing machine of the present invention.

Figure 1A:
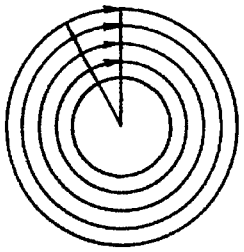
FIGS. 1A and 1B are diagrams showing the swirl dynamics system applied to a chaos washing machine in accordance with the present invention.
Figure 1B:
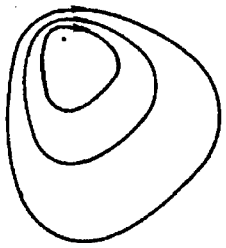

Referring to FIG. 1, there is shown a motion (a kind of swirl motion) in which a number of mass points in the dynamics system rotates towards the periphery from the center of the cavity, in which FIG. 1A shows a symmetrical motion thereof and FIG. 1B shows an asymmetrical motion thereof.

Figure 2A:
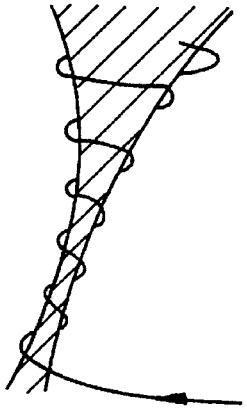
FIGS. 2A and 2B are three dimensional diagrams showing a general swirl.
Figure 2B:
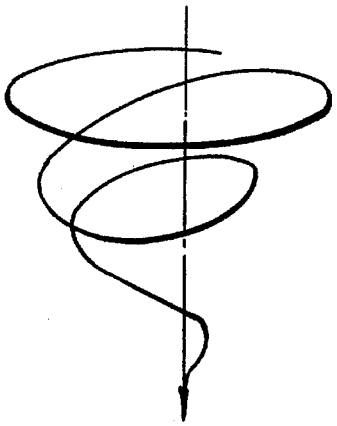
Figure 3:
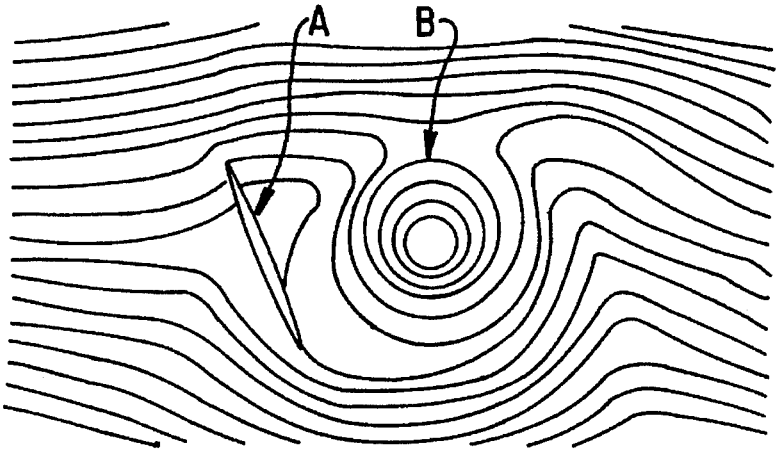
FIGS. 3 is a diagram showing the swirl in laminar flow generated from the back side of an obstacle as an obstacle is located.

These swirl motions in a three dimensional model as they occur in the natural world with their spiral motion appear as shown in FIGS. 2A and 2B. In this spiral motion of water, the laminar flow is regular the flow of water is regular. When an obstacle A which interrupts the flow of water in its laminar flow, a swirl B occurs at an edge portion thereof as shown in FIG. 3.

The ratio of the inertia power to the viscosity power indicated as the Reynold's number and is used to analyze the water flow. The Reynold's number is represented as by a formula as follows:

$$Re=LV/v \quad (1)$$

L: Characteristic length

V: Velocity v: Viscosity coefficient

Because the Reynold's number represents the ratio of the inertia power to the viscosity power, the greater the Reynold's number more water particles change from normal flow and move irregularly.

Figure 4A:
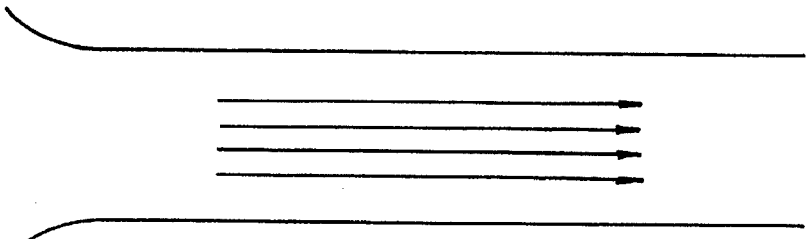
FIGS. 4A and 4B are diagrams explaining the relationship between the flow of water and the Reynold's number in the general cylinder.
Figure 4B:
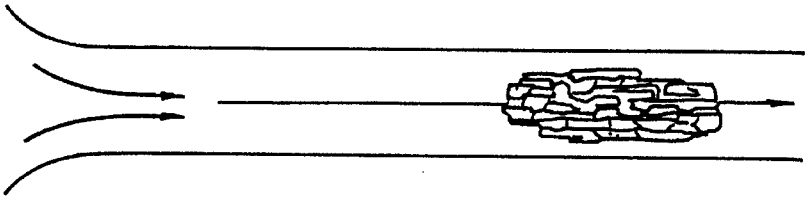

That is, when dyestuffs flow into water in the cylinder, if the Reynold's number is below the predetermined value-(critical value), the stream of water becomes a regular laminar flow as shown in FIG. 4A. However, if the velocity of water increases, the Reynold's number also increases and then exceeds the critical value. In this case, it may be observed that dyestuffs are irregularly mixed with each other as shown in FIG. 4B. Such a random water current also appears to the rotating fluid Likewise, if the Reynold's number exceeds the critical value, the irregular motion may be formed. These motions are called "a turbulent flow".

The turbulent flow is an irregular fluid motion in which physical measurement such as a velocity and a pressure may vary to the time end the space, and is a kind of energy exchange process. This exchange velocity is very fast, and several tens to several hundreds times greater than the swirl diffusion in the laminar flow. Generally, energy is transmitted from the big swirl in the turbulent flow to the small swirl therein.

If the swirl is created by an obstacle in the stream of the laminar flow, the turbulent flow creates the swirl in case of producing an obstacle in the stream as the laminar flow. When the fluid discharges through the hole of an airtight container, the stream of the produced swirl is unstable. Also, the Reynold's number in this case represents a high value. As stated above, it may be observed that a random generation exists in the turbulent flow and the motion of water particles become unstable and irregular.

In the turbulent flow, when the energy delivery from one side of the stream to other side thereof is not smooth, the energy is wasted among the mass of water particles. These sudden changes in the energy from one side of the stream to other side thereof causes an eddy and a swirl.

The eddy and the swirl can improve the solution degree of a detergent and a chaotic stream of water can divide water particles. In the dividing process, a gas is exhausted. When the chaotic motion of water is continued for a specified time, a large quantity of foam may be produced. This foams in the nonlinear dynamic system may be randomly moved with the particles of the detergent and can improve the solution degree of the detergent.

Therefore, according to the present invention, in the chaotic motion, so-called chaos water current created in the water may be strongly produced.

That is, the present invention may use a chaotic motion and a convection current development of water.

The convection current of water is a kind of heat transfer and is a nonlinear dynamic motion. These are represented as Lorenz Attractor which serve as an example of a chaos development.

In the convection current, the kinetic energy of water particles may be increased through the supply process of heat energy that is called heating. To boil laundry means that the kinetic energy of the increased water particles is delivered to a spot which is strained in clothes and the washing ratio can improve. Therefore, the washing power of a laundry can be greatly improved by boiling and washing.

Further, the overall water current because of the convection current brings about a result which increases the washing ratio, the present invention may not use the heat transfer, but the water motion in the convection current simulated by using a strong power source such as a jet motor.

As stated above, when the velocity and the kinetic energy of water particles are increased by using a strong power source such as a jet motor, the Reynold's number may make a critical value or more and the flow or water may be chaotic. Accordingly, the present invention has the same effect as that of boiling and washing by allowing the overall flow of water to appear during the convection current development.

Figure 5:
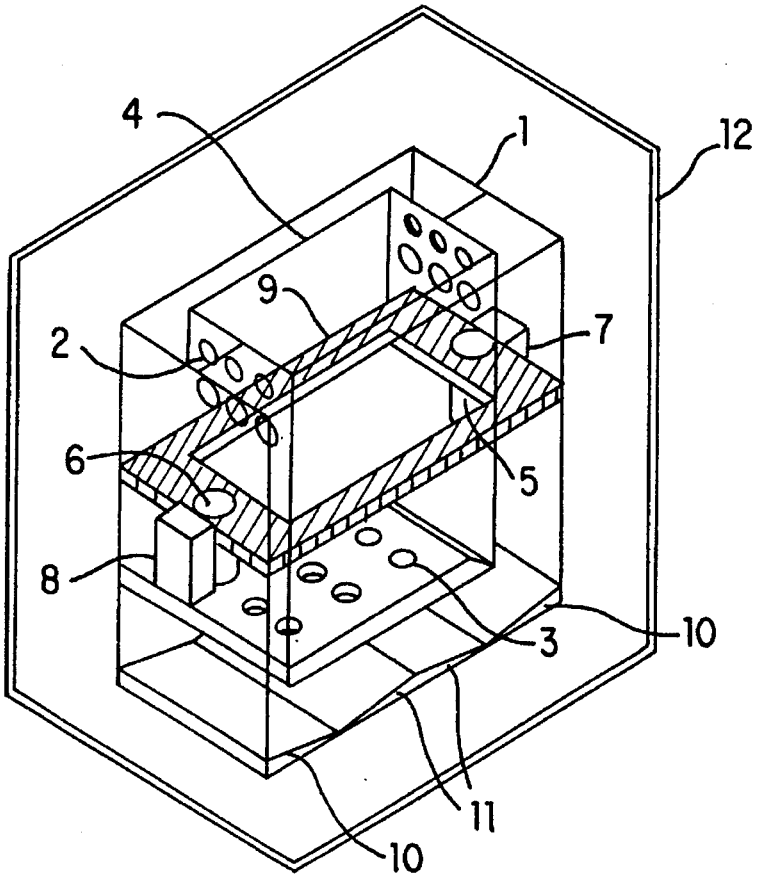
FIG. 5 is a perspective view of a chaos washing machine in accordance with the present invention.
Figure 6:
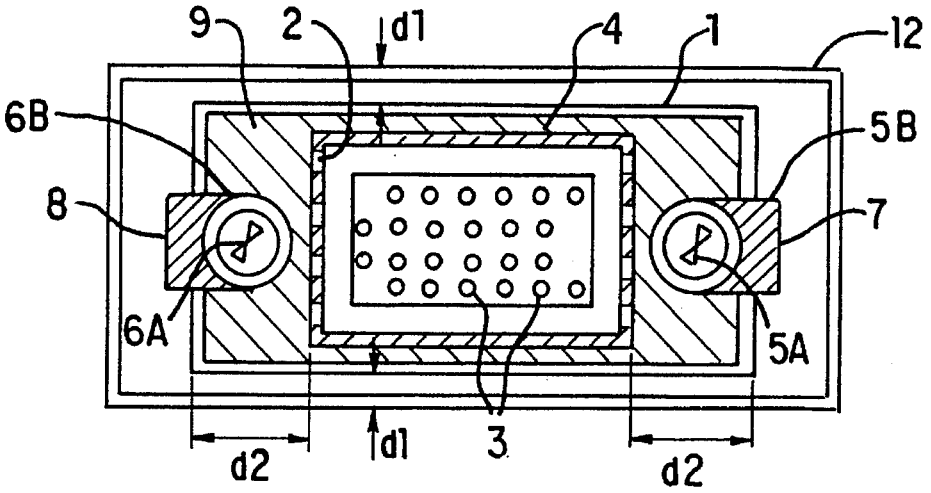
FIG. 6 is a plan view of FIG. 5.
Figure 7:
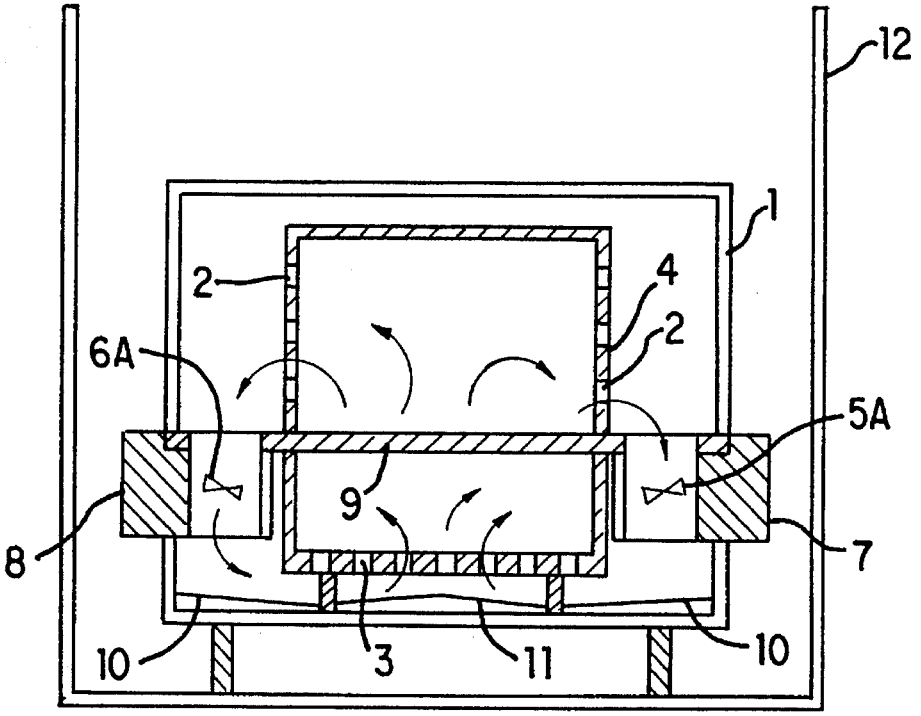
FIG. 7 is a cross sectional view of FIG. 1.

FIGS. 5 to 7 are perspective views, a plan view and a cross sectional view of a chaos washing machine in accordance with the present invention which improves the washing effect and performs the washing by producing the above strong chaos water current development.

Referring to FIGS. 5 to 7, the chaos washing machine in accordance with the present invention is composed of a water tank 1 containing water, a washing tank 4 disposed in the water tank 1 to maintain a predetermined space from all side walls of the water tank 1 and having a plurality of discharge holes 2 in a pair of walls which is opposite to each other and a plurality of suction holes in the bottom thereof so that water can be discharged from the discharge holes and be sucked in the suction holes, a first fan 5 and a second fan 6 disposed in the space between the washing tank 4 and the water tank 1, the space where the discharge holes 2 of the washing tank 4 is, the first fan pushes water in the suction holes 3 of the washing tank 4 by creating a strong current and the second fan pushes in the suction holes 3 by sucking water discharged into the discharge holes 2 of the washing tank 4, a first fan driving motor 7 and a second driving motor 8 for driving the first and the second fans 5 and 6, respectively, a water barrier or divisional plate 9 for interrupting the stream of water not passing through the washing tank 4 by dividing the space between the water tank 1 and the washing tank 4 on the basis of the height of the fans into two space portions in which the discharge holes 2 and the suction holes 3 are disposed, a first current guide portion 10 and a second current guide portion 11 for guiding a water current pushed in the suction holes 3 of the washing tank 4 by the operation of the fans 5 and 6, and a noise cut off wall 12 for supporting the overall of the washing machine and for isolating a noise.

The first current guide portion 10 may be provided in the lower bottom of the fans 5 and 6 which are disposed between the water tank 1 and the washing tank 4 and has a descent taper in the direction of the suction holes 3 of the washing tank 4, while the second current guide portion 11 may be extended from the longitudinal section of the first current guide portion 10 and has an ascent taper in the direction of the suction holes 3 of the washing tank 4. The divisional plate 9 may be placed at the same height as the upper end of the first and the second fans 5 and 6.

As shown in FIG. 6, the fans 5 and 6 are composed of rotation wings 5A and 6A and motor interface portions 5B and 6B which are protecting the rotation wings 5A and 6A and are serving as suction/discharge passages of a strong water current production.

In FIG. 6, the chaos washing machine for using the convection current according to the present invention includes the spaces between the water tank 1 and the washing tank 4. In the spaces, the distance d2 between the water tank 1 and the washing tank 4 is positioned in the space where the fans 5 and 6 are disposed, while the distance d1 between the water tank 1 and the washing tank 4 is positioned in the space where the fans 5 and 6 are not disposed. The distance d2 is a sufficiently larger distance than the distance d1, that is, d1<<d2. This relationship helps to introduce a strong flow of water that contacts the laundry.

Hereinbelow, the operation of the chaos washing machine in accordance with the present invention as constructed above will be explained.

The detergent and water are fed into the washing tank 4 and the water tank 1, while the laundry is contained in the washing tank 4. In this state, when the first and the second fan driving motors 7 and 8 operate, the rotation wings 5A and 6A are rotated at high speeds.

The high speed water current may be created in the space between the water tank 1 and the washing tank 4 by means of the high speed rotation of the rotation wings 5A and 6A and then water positioned at the upper space of the divisional plate 9 say be sucked in the space therebetween. At this time, the sucked water may be discharged into the lower space, that is, the bottom of the water tank and the washing tank, of the divisional plate 9. The water current is created by rotating of the rotation wings 5A and 6A and then is introduced to the lower portion of the water tank. The introduced water current may be hit against the bottom of the washing tank 4 through the passage which is positioned to the bottom side of the water tank.

The inflow process of water from the bottom of the water tank 1 to the inner portion of the washing tank 4 will be explained in detail.

The first water current guide portion 10 may introduce water discharged from the rotation wings 5A and 6A from the side wall of the water tank 1 to the center of the washing tank 4, while the second water current guide portion 11 may introduce the water current introduced into the first water current guide portion 10 in the direction of the suction holes 3 which are positioned at the bottom center of the washing tank 4.

Water introduced by both water current guide portions 10 and 11 may collide with each other in the center and then the water particle may be broken and be randomly moved so that a large quantity of foam is created.

When the fans continuously operate, water may be further pushed in the lower portion of the water tank 1. Then, water which is collected in the bottom center of the washing tank 4 by the water current guide portions 10 and 11 may be forced into the washing tank 4, passing through the suction holes 3 at high speeds because the only exits are the suction holes 3 in the bottom of the washing tank 4.

Water in a high pressure condition is generated because water passing through the suction holes 3 passes through a narrow hole.

At this time, because the edge of the holes serves as an obstacle, a large quantity of foams and an eddy and a swirl may occur in water passing through the holes.

These foams and the eddy and the swirl can improve the solution degree of the detergent and the motion of water particle in which the kinetic energy is continuously increased by the fan driving motors 7 and 8 which can remove a pollutant adhered to clothes.

The continuous flow of water which is strongly directed to the washing tank 4 from the bottom thereof by being continuously rotated by the fans 5 and 6 may allow the foams to collide with the structure of the laundry, to be broken and then be produced again. A pollutant adhered to the laundry can be removed by repeatedly performing this process.

The water current strongly flowing from the bottom of the washing tank 4 to the upper side thereof can increase the cleansing ratio and improve the solution degree of the detergent by removing a pollutant.

Water continuously introduced through the suction holes 3 of the washing tank 4 may be discharged into the space between the washing tank 4 and the water tank 1 through the discharge holes 2 which are positioned to the side of the washing tank 4, that is, in the upper portion of the divisional plate 9.

Because the distance d2 between the water tank 1 and the washing tank 4 in the space portion where the fans 5 and 6 are disposed is sufficiently greater than the distance d1 between the water tank 1 and the washing tank 4, the discharged water may strongly be introduced into the fans 5 and 6, and may be sucked in the rotation wings 5A and 6A by being continuously rotated by the fan driving motors 7 and 8 and may be pushed into the bottom of the washing tank 4. This process is repeatedly performed.

As the flow of water not in contact with the laundry is of aid to the cleansing, the divisional plate 9 isolates the flow of water not passing the washing tank 4 so that the waste of energy can be reduced and the operating energy of fan driving rotors 7 and 8 is concentrated to create a strong water current.

When a predetermined time is lapsed, the operation of the fan driving motors 7 and 8 may be stopped. When the fan driving motors 7 and 8 are not operated, the flow of water stops and is progressively stabilized. When such time is lapsed, the flow of water occurs by again operating the fan driving motors 7 and 8.

The high cleansing ratio and the removal of a pollutant can be obtained by periodically and repeatedly performing these operations. Also, the overall flow of water for simulating the convection current development and an unimportant chaotic development which are produced in the bottom can form a chaotic condition thereby being of aid to the washing.

Figure 8:
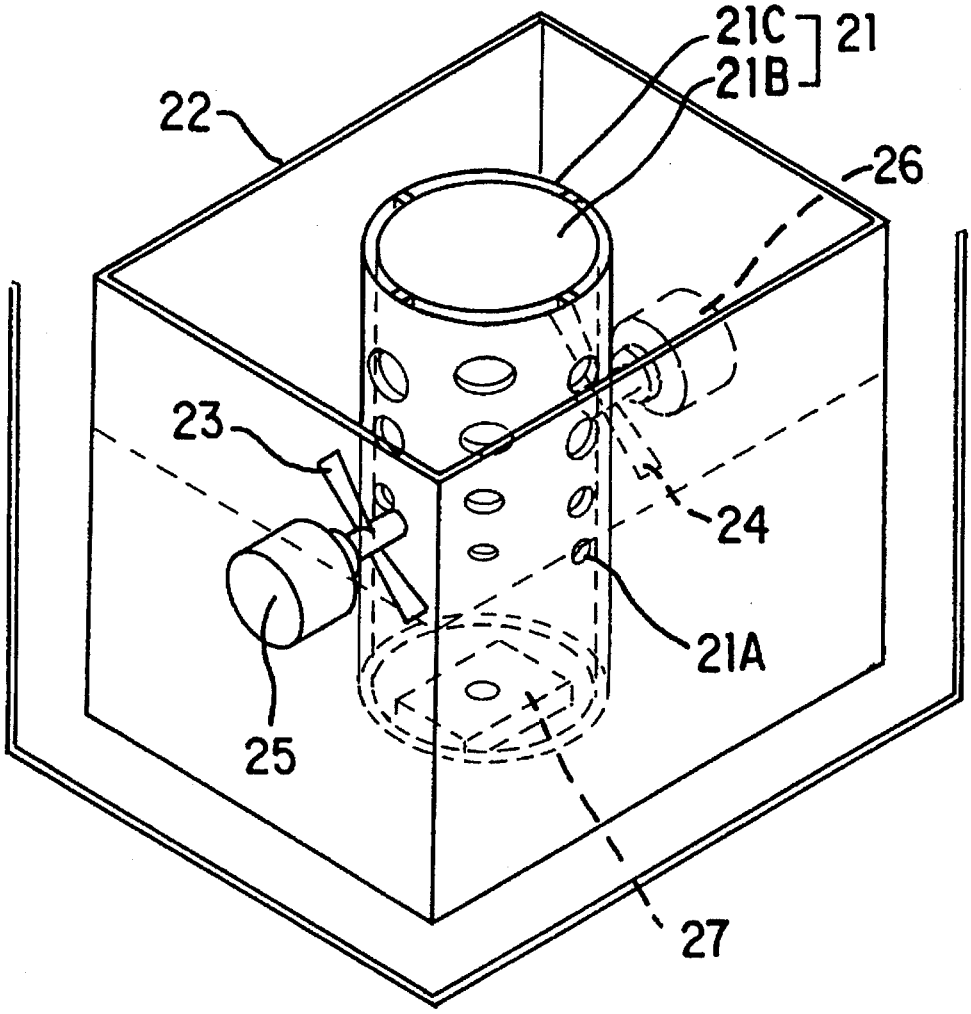
FIG. 8 is a perspective view showing a chaos washing machine in accordance with a first embodiment of the present invention.
Figure 9A:
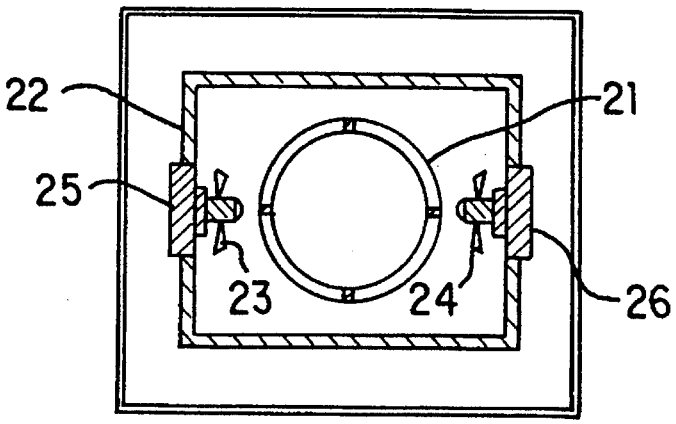
FIGS. 9A and 9B are a plan view and a cross sectional view of FIG. 8, FIGS. 10 A to 10C are views showing the variation of a water level created due to the washing method by using a chaos washing machine of FIG. 8, and FIGS. 11A and 11B are views showing the water current pattern created due to the washing method of using a chaos washing machine of FIG. 8.
Figure 9B:
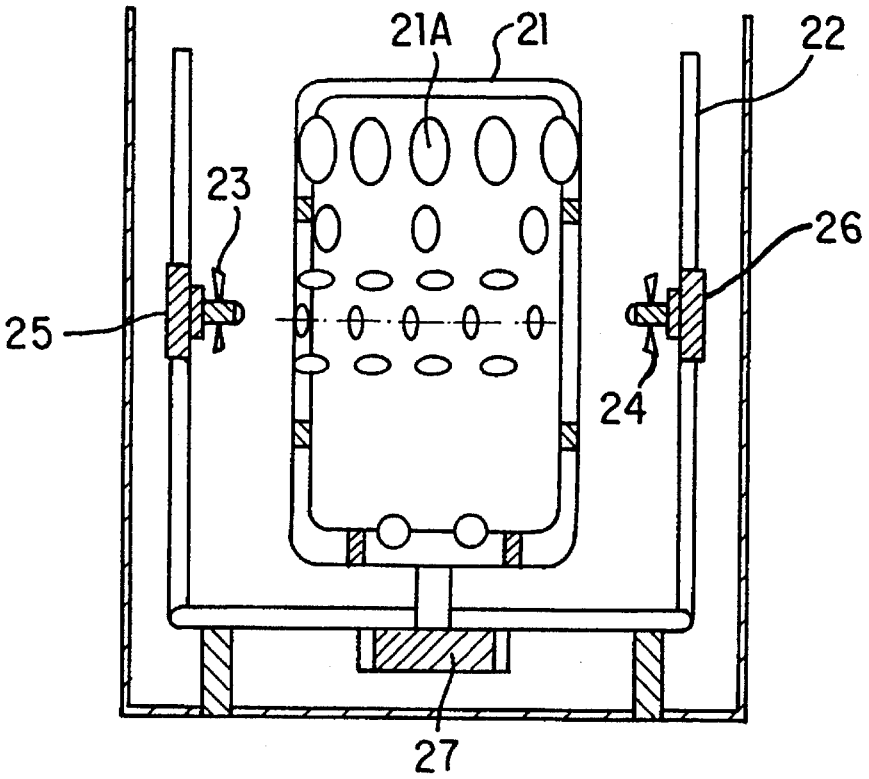

FIG. 8 and FIGS. 9A and 9B are perspective views, a plan view, and a cross sectional view showing the first embodiment of chaos washing machine in accordance with the present invention.

Referring to FIGS. 8 and 9, the chaos washing machine of the present invention is composed of a first washing tank 21 having a plurality of induce holes 21A for inducing the water current in which a detergent dissolved into the space where the laundry is contained, a second washing tank 22 for enclosing the first washing tank 21 to be filled with water and a detergent, water current fans 23 and 24 creating a turbulent flow of water in which a detergent is dissolved and pushing the created turbulent flow from the second washing tank 22 through the induce holes 21A into the first washing tank 21, fan motors 25 and 26 for driving the water current fans 23 and 24, respectively, and a washing tank motor 27 for rotating the first washing tank 21.

The inducing holes 21A of the first washing tank 21 increase in diameter in the direction of the upper portion thereof and the first washing tank 21 has a double structure comprising an inner tank 21B filled with laundry and an outer tank 21C formed with the inducing holes 21A, and a pair of fans 23 and 24 and fan motors 25 and 26 are placed opposite to each other.

The description of the washing method by the chaos washing machine as constructed above is as follows;

First, the washing method of the present invention includes the first step of creating a turbulent flow by the operation of fans 23 and 24 and fan motors 25 and 26 and pushing the created turbulent flow in the first washing tank 21 through the inducing holes 21A, stopping the operation of the fans 23 and 24 and the fan motors 25 and 26 when a water level in the first washing tank 21 is raised to the predetermined height and discharging water in the first washing tank 21 through the induce holes 21A into the second washing tank 22, and the third step of rotating the first washing tank 21 to a regular angle when the water level in the first washing tank 21 is dropped to the predetermined height by performing the first step and repeatedly operating the above steps.

The effect of the above embodiment in connection with FIGS. 8 to 11 will be described below.

Figure 10A:
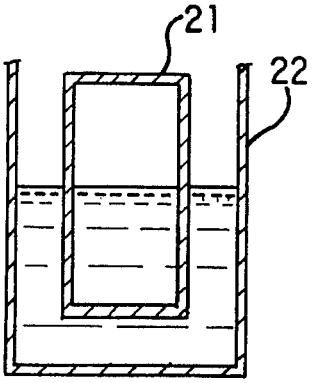

First, as shown in FIG. 10A, water is filled in a first washing tank 21 and a second washing tank 22 and then laundry and a detergent are deposited therein.

In the equilibrium state, the water level of the first washing tank 21 is identical with that of the second washing tank 22. This state assumes the position as shown in FIG. 4A.

Then, when the fan motors 25 and 26 are operated by applying electric power, the fans 23 and 25 may be rotated at high speeds. A strong chaos water current may be created in the second washing tank 22 by the high speed rotation of the fans 23 and 24.

Figure 10B:
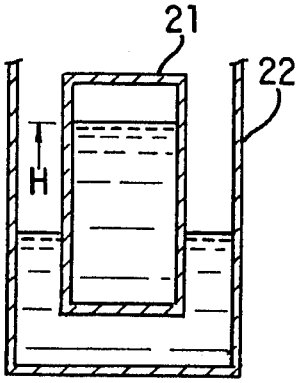
Figure 10C:
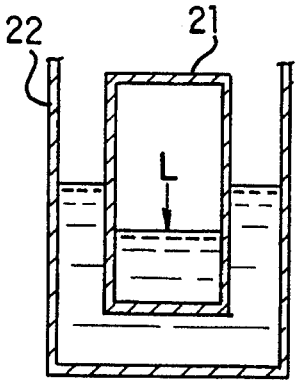

The current of water may be pushed from the second washing tank 22 through the induce holes 21A into the first washing tank 21 by such created current. By the current of water pushed therein, the water level in the first washing tank 21 is increased as shown in FIG. 10B, while that in the second washing tank 22 is reduced.

Figure 11A:
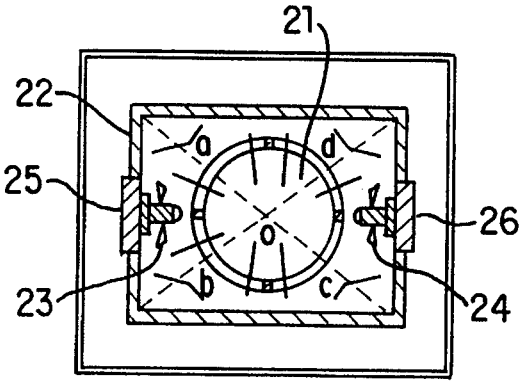

At this time, the direction of the water current pushing in the first washing tank 21 may be divided into a direct entering direction to region a-o-b, c-o-d where are directly opposite to the fans 23 and 24 in FIG. 11A and into an indirect entering direction to region a-o-d, b-o-c where the water current by the fans 23 and 24 meet by turning around the periphery of the first washing tank 21.

The water current entering into region a-o-d, b-o-c may be hit at the region with the water current which is created by two fans 23 and 24 and is turned around the periphery of the first washing tank 21. The hit water current may be pushed in the first washing tank 21 through the induce holes 21A by the law of conservation momentum. The region a-o-d, b-o-c indirectly receiving the water current is called an indirect chaos region, while the region a-c-b, c-o-d directly receiving the water current is called a direct chaos region.

In such chaos regions, the detergent may be dissolved because a strong chaos water current is created by the high speed rotation of the fan 3. The water in which the detergent is dissolved may be introduced in the first washing tank 21 and the water level of the first washing tank 21 may be increased as shown in FIG. 10B. The height difference H of such water level can compress the laundry in the first washing tank 21.

The fans 23 and 24 may be rotated in high speed until the water level of the first washing tank 21 is reached to the predetermined height H. When the water level of the first washing tank 21 is reached to the height H, the rotation of the fans 23 and 24 stops by stopping the fan motors 25 and 26.

When the rotation of the fans 23 and 24 is stopped, water in the first washing tank 21 may be discharged through the induce holes 21A into the second washing tank 22 by the increased water level H in the first washing tank 21. Water can be fast discharged because the higher the induce holes 21A are located, the bigger their diameter becomes.

Accordingly, the water level L in the first washing tank 21 may be reduced, whereas that in the second washing tank 22 may be increased. In this condition, the laundry my be pressed in the opposite direction of FIG. 10B. The moment the rotation of the fans 23 and 24 is stopped, the first washing tank 21 may be rotated in a 90 degree and as shown in FIG. 4B by being driven the washing tank drive motor 27.

Figure 11B:
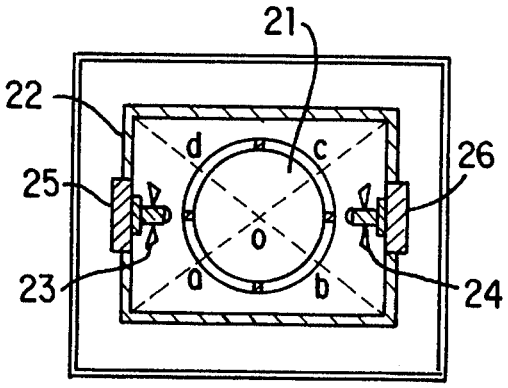

When the first washing tank 21 is rotated as shown in FIG. 11B, a direct chaos region a-o-b, c-o-d and an indirect chaos region a-o-d, b-o-c as stated above are changed each other.

After this, the above process is repeated. The result is that the laundry may be pressed up and down according to the water level variation in the first washing tank 21, water may be pushed in the first washing tank 21 by the high speed rotation of the fans 23 and 24 and then a chaos water current may be created by producing a partial chaotic development in passing through the induce holes 21A.

On the other hand, as the water level in the first and the second washing talks 21 end 22 may be varied by the high speed, rotation of the fans 23 and 24, the larger chaos water current is created. As the upward and downward motion of water accompanying the motion by means of such turbulent flow presses the laundry, the washing effect can be improved.

As stated above, according to the chaos washing machine of using a convection flow of the present invention, the laundry is not wrinkled. Therefore, the present invention eliminates the need for mechanically and electrically means for sensing the wrinkle of the laundry or for proceeding the twist preventing pattern of the laundry such as the prior pulsator washing tank thereby easily accomplishing the structure of the washing machine and the design and the operation of the control program.

Further, according to the present invention, the laundry will be not rotated with the washing tank. Therefore, the present invention can reduce the damage created to the laundry that is created by being regular and reverse rotation of the laundry such as the prior pulsator or drum washing machines thereby extending the life of cloth and maintaining the cleanliness of clothes after washing.

While the invention has been particularly shown and described with reference to preferred embodiments thereof, it will be understood by those skilled in the art that any modification and other changes in form and details can be made therein without departing from the spirit and scope of the invention.

What is claimed is:

1. A chaos washing machine comprising:

a) a water tank for containing water and a dissolved detergent, said water tank having side walls and a bottom;

b) a washing tank disposed in said water tank and maintained a predetermined space from said water tank, said washing tank including side walls having a plurality of discharge holes and a bottom having a plurality of suction holes;

c) a first fan and a second fan disposed in the space between the washing tank and the water tank, the first fan forcing water in the suction holes in the bottom of the washing tank by creating a strong current and the second fan forcing water in the suction holes by sucking water discharged into the discharge holes in the side walls of the washing tank; and d) a first driving motor and a second driving motor for driving the first and second fans, respectively.

2. A chaos washing machine according to claim 1, further including first and second current guide portions for guiding a water current forced in the suction holes of the washing tank by the operation of said fans.

3. A chaos washing machine according to claim 2, wherein the first current guide portion is provided in the bottom of the water tank and below the fans which are disposed between the water tank and the washing tank and has a descent taper in the direction of the suction holes of the washing tank, and the second current guide portion is extended from a longitudinal section of the first current guide portion and has an ascent taper in the direction of the suction holes of the washing tank.

4. A chaos washing machine according to claim 1, wherein the discharge holes of the washing tank are disposed in the wall in the direction where the fans are placed.

5. A chaos washing machine according to claim 1, wherein the first and the second fan driving motors have a pause time at regular intervals to be periodically driven.

6. A chaos washing machine according to claim 1 further including a divisional plate for interrupting the stream of water not passing through the washing tank by dividing the space between the water tank and the washing tank on the basis of the height of the fans into two space portions in which the discharge holes and the suction holes are disposed.

7. A chaos washing machine according to claim 6, wherein the divisional plate is provided in the same height as the upper end of the first and the second fans.

8. A chaos washing machine comprising;

(a) a water tank for containing water and a dissolved detergent;

(b) a washing tank disposed in said water tank, said washing tank being spaced from said water tank for defining (1) a vertical space about said washing tank between said water tank and said washing tank and (2) a bottom space between said water tank and said washing tank;

(c) a water barrier at an intermediate height of said washing tank, said water barrier surrounding said washing tank in said vertical space between said washing tank and said water tank;

(d) said washing tank having a plurality of discharge holes open to said vertical space above said water barrier, and a plurality of suction holes open to said bottom space;

(e) first and second fans respectively disposed in the space between the washing tank and the water tank of said water barrier for circulating said water and dissolved detergent out of said discharge holes, through said water barrier and into said suction holes; and (f) first and second fan driving motors for respectively driving the first and second fans.

9. A chaos washing machine according to claim 8, further comprising first and second current guide means in said bottom space beneath said first and second fans, respectively, for directing water and dissolve detergent upwardly toward said suction holes.

* * * * *